United States Patent [19]

Deutsch

[11] Patent Number: 4,827,547

[45] Date of Patent: May 9, 1989

[54] MULTI-CHANNEL TONE GENERATOR FOR AN ELECTRONIC MUSICAL INSTRUMENT

[75] Inventor: Ralph Deutsch, Sherman Oaks, Calif.

[73] Assignee: Deutsch Research Laboratories, Ltd., Sherman Oaks, Calif.

[21] Appl. No.: 40,398

[22] Filed: Apr. 20, 1987

[51] Int. Cl.[4] ..... G10H 1/043; G10H 1/10

[52] U.S. Cl. ..... 84/1.24; 84/DIG. 4

[58] Field of Search ..... 84/1.24, DIG. 4, 1.22, 84/1.23, 1.26, 1.27, 1.19

[56] References Cited

U.S. PATENT DOCUMENTS

| | | | |
|---|---|---|---|
| 3,908,504 | 9/1975 | Deutsch | 84/1.22 X |
| 4,085,644 | 4/1978 | Deutsch et al. | 84/1.01 |
| 4,103,582 | 8/1978 | Chibana | 84/1.24 |
| 4,112,803 | 9/1978 | Deutsch | 84/1.24 |
| 4,171,658 | 10/1979 | Aoki et al. | 84/1.24 X |
| 4,215,614 | 8/1980 | Chibana | 84/1.22 X |
| 4,257,303 | 3/1981 | Nagai et al. | 84/DIG. 4 X |
| 4,280,388 | 7/1981 | White | 84/DIG. 4 X |
| 4,495,847 | 1/1985 | Deutsch et al. | 84/1.19 X |

*Primary Examiner*—Arthur T. Grimley
*Assistant Examiner*—John G. Smith
*Attorney, Agent, or Firm*—Ralph Deutsch

[57] ABSTRACT

A keyboard operated electronic musical instrument has a number of tone generators each of which creates a plurality of musical tones each having its own independent frequency offset so that a multi-rank ensemble effect is produced. The tones are produced by computing, in real time, sequences of data points using stored sets of harmonic coefficients. Provision is incorporated for producing a musical celeste effect.

22 Claims, 11 Drawing Sheets

MULTI-CHANNEL TONE GENERATOR FOR AN ELECTRONIC MUSICAL INSTRUMENT

BACKGROUND OF THE INVENTION

1. Field of the Invention

This invention relates to musical tone synthesis and in particular is concerned with a system for simultaneously generating a plurality of tone channels each having an ensemble effect.

2. Description of the Prior Art

A realistic electronic simulation of an air driven pipe organ requires the generation of musical waveshapes for a number of families of tones each having the same approximate fundamental frequency for the pipes in each family corresponding to the same instrument keyboard switch. The fundamental frequency should be slightly different for each tone family so that the desired ensemble effect is achieved. A second requirement for the ensemble effect is that an exact tuning of the notes within a given tone family is not a desirable goal. Instead the tuning of the individual notes should vary from the true frequency by some random tuning error which is typical of the tuning errors found in an air driven pipe organ.

Digital tone generators have been disclosed which attempt to replicate either pipe organ tones as well as the tones produced by the conventional acoustic musical instruments. Digital tone generators are attractive systems because they can be implemented economically with relatively low cost microelectronic circuitry.

In the musical instrument described in U.S. Pat. No. 3,515,792, musical tones are produced by storing a digital representation of a waveshape characteristic, e.g. of an organ pipe tone, and repetitively reading out this stored waveshape at a selectable clock rate determining the fundamental frequency of the produced note. Stored in the waveshape memory are the actual amplitude values at a plurality of sample points. A frequency synthesizer produces a clock signal at a rate determined by the note selected on the instrument's keyboards. The stored amplitudes are read out of the memory repetitively at the selected clock rate to generate the selected musical tone.

In the musical instrument described in U.S. Pat. No. 3,809,786 musical tones are produced by computing, in real time, the amplitudes at successive points of a waveshape and converting these amplitude points to musical tones as the computations are performed. A conventional discrete Fourier transform is implemented to compute each amplitude point from a stored set of harmonic coefficients and a selected value of a frequency number which establishes the period of the generated musical waveshape. At each timing signal furnished by a logic clock, the frequency number is added to the contents of an accumulator. The number contained in this accumulator corresponds to the time variable in the output musical waveshape. In between the times that the frequency number is added to this accumulator, the accumulator content is successively added to a second adder-accumulator for a number of times which is equal to the maximum number of harmonic coefficients in a set stored in a harmonic coefficient memory. After each addition to the second accumulator, the accumulated value is used to address a trigonometric function value from a sinusoid table. Each read out trigonometric value read out from the table is multiplied by a harmonic coefficient whose order is associated with the number of times the accumulated frequency number has been added to the accumulator in the second adder-accumulator. The individual products are summed for the number of harmonic coefficients in the stored set to generate the desired waveshape amplitude point. The ADSR envelope amplitude modulation is obtained by scaling the set of harmonic coefficients as they are read out of memory and before they are multiplied by the corresponding read out trigonometric function values.

In the musical instrument described in U.S. Pat. No. 4,085,644 musical tones are produced by computing (not in real time) a master data set, transferring the master data set to buffer memories, and repetitively converting in real time the contents of the buffer memories to musical tones. The master data set is created repetitively and independently of the tone generation by computing a discrete Fourier transform algorithm using stored sets of harmonic coefficients. A time shared digital-to-analog converter transforms the data read out from the buffer memories to tone channels and provides ADSR amplitude modulation.

It is an object of the present invention to produce musical tones having an ensemble effect corresponding to that produced by several independent ranks of organ pipes. It is a further object of the present invention to produce musical tones of the celeste family of tones.

SUMMARY OF THE INVENTION

In a keyboard operated musical instrument a multi-channel tone generator is assigned to each actuated keyswitch. A different frequency number is generated for each of the individual multi-channels. These individual frequency numbers correspond to the frequency associated with the actuated keyswitch and are each slightly different from a true nominal frequency number thereby leading to the production of a plurality of musical tones having an ensemble effect.

A discrete Fourier algorithm is implemented to compute the musical waveshapes of each of the multi-channels in real time. A single computing means is time shared between the multi-channels. A different set of stored harmonic coefficients is used in the computation of the set of musical waveshapes. Provision is incorporated to limit the maximum frequency of the overtones of any note in response to stored values of harmonic cutoff numbers. The harmonic limiting is obtained in a smooth fashion by gradually forcing the trigonometric value used in the discrete Fourier transform to a zero value and then maintaining the zero value for any harmonics that are higher in number than a prespecified maximum harmonic number.

An envelope modulation means is incorporated so that each one of the multi-channels can have its own individual attack/decay/sustain/release envelope shape.

BRIEF DESCRIPTION OF THE DRAWINGS

The detailed description of the invention is made with reference to the accompanying drawings.

DETAILED DESCRIPTION OF THE INVENTION

The present invention is directed toward a multichannel musical tone generator in which an ensemble effect is created between the tones in each of the channels.

Figure 1:
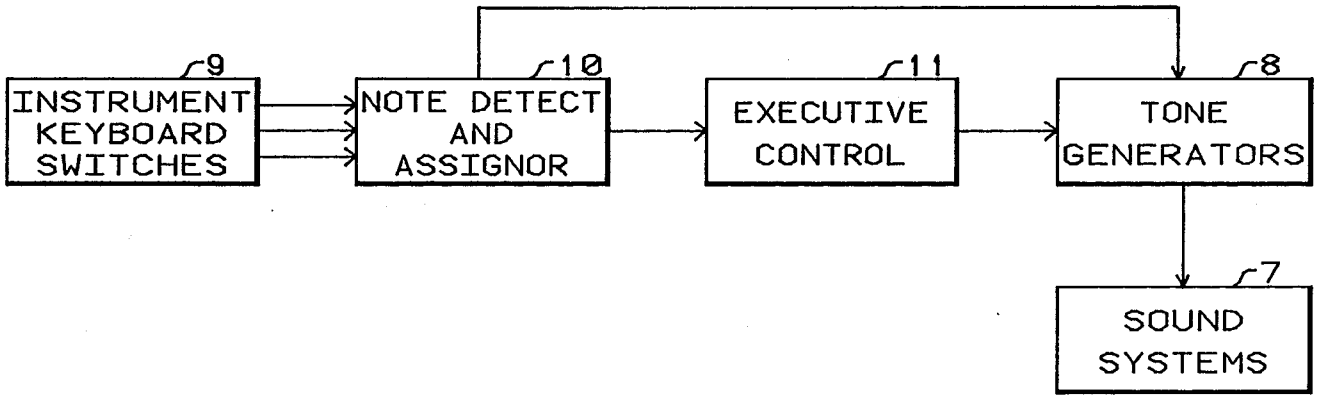
FIG. 1 is a system diagram of the musical instrument.

FIG. 1 illustrates an embodiment of the present invention. The keyboard switches are contained in the system logic box labeled instrument keyboard switches 9. If one or more of the keyboard switches has a switch status change and is actuated ("on" switch position), the note detect and assignor 10 encodes the detected keyboard switch having the status change to an actuated state and stores the corresponding note information in a memory which is contained in the note detect and assignor 10. The encoded note information contains a designation for the frequency data to be transferred to a tone generator in the set of tone generators 8 which is assigned to an actuated keyswitch using the encoded detection data generated by and stored in the note detect and assignor 10.

A suitable configuration for a note detect and assignor 10 subsystem is described in U.S. Pat. No. 4,022,098 entitled "Keyboard Switch Detect And Assignor." This patent is hereby incorporated by reference.

The executive control 11, in a manner described below, uses the encoded detection data stored in the note detect and assignor 10 to control the operation of an assigned tone generation in the set of tone generators 8.

The musical waveshapes generated by the plurality of tone generators are converted into audible muscial sounds by means of the sound systems 7.

Figure 2:
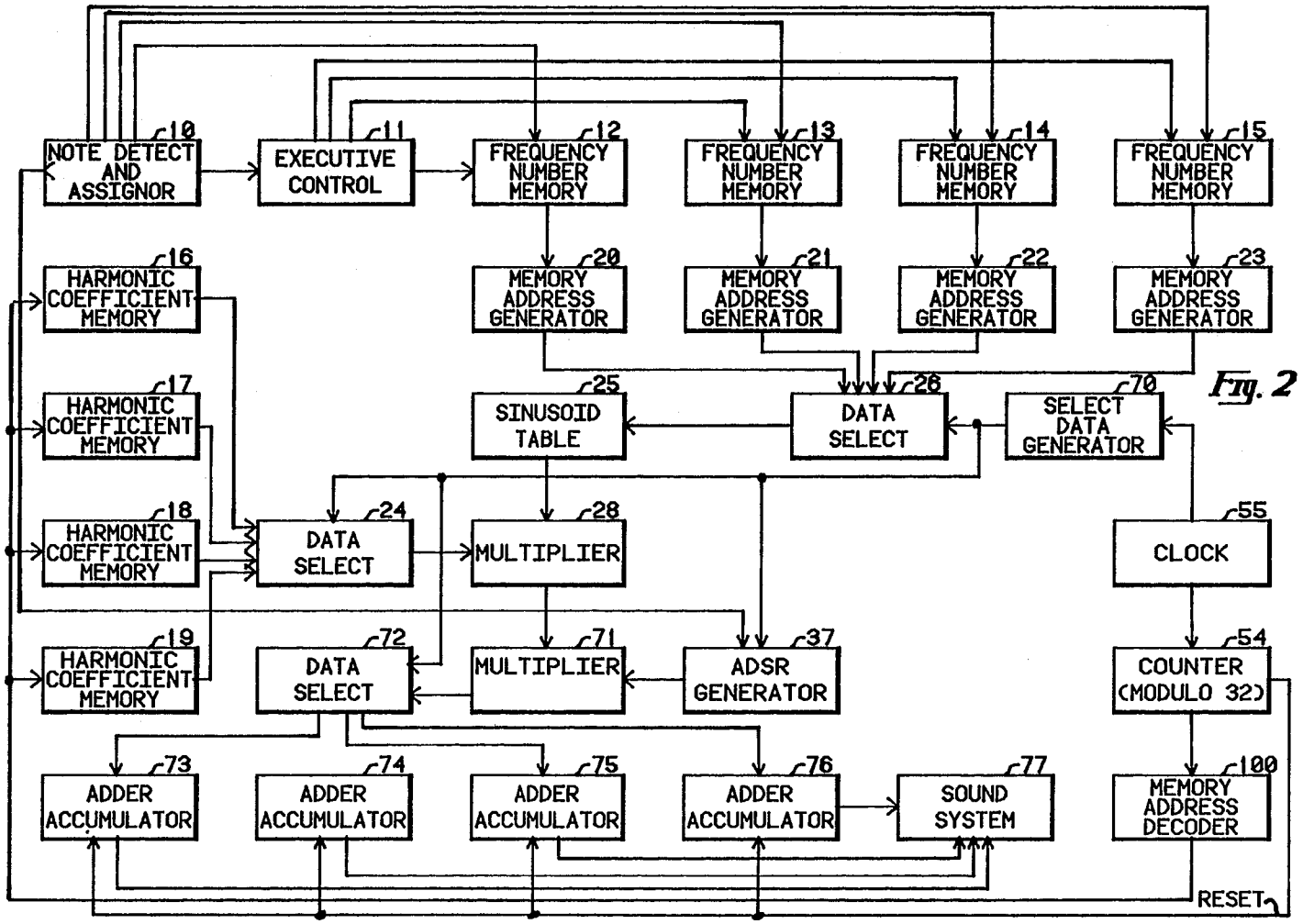
FIG. 2 is a system diagram of a tone generator.

FIG. 2 illustrates the details of one of the tone generators contained in the set of tone generators 8. The note detect and assignor 10 and the executive control 11 have system functions which are time shared between all of the plurality of tone generators.

When a keyswitch closure has been detected, a detect data word is encoded and stored in a memory by the note detect and assignor 10. This detect data word identifies the keyboard array, octave within the array, and the muscial note within the octave. The stored detect data word is used to read out a corresponding frequency number from each of the four frequency number memories 12, 13, 14 and 15. The frequency number memories 12–15 can be implemented as read-only addressable memory (ROM) containing frequency number data words stored in digital binary numeric format. These frequency $R_{CN}$ numbers have values equal to $$R_{CN}=2^{(N-G)/12}+et(CN) \qquad \text{Eq. 1}$$

where N has the range of values N=1,2, . . . , G-1 and G-1 is equal to the number of keyswitches on the musical instrument's keyboard. The subscript C denotes a tone channel number while N denotes the keyswitch number. The number et(CN) is a random number that is added (or subtracted if it is negative) to each frequency number so that a deliberate frequency error is programmed to cause the output musical sounds to have an ensemble effect with respect to musical sounds generated within a channel as well as with respect to musical sounds generated in another channel. The values of et(CN) can be chosen as random numbers to produce the desired ensemble effect. The first term on the right-hand side of Eq. 1 is the true frequency number while et(CN) is an offest numerical value used to provide a deliberate frequency error to provide the desired musical ensemble effect. For a musical tone generator designed to cover musical frequencies in the range of musical notes $C_2$ (frequency=65.41 Hz) to $C_7$ (frequency=2093 Hz), an acceptable system design choice is to store the frequency numbers in a binary digit format having a word length of 15 bits. This word size provides for a tuning error variation in the range of 0.90 cents to −2.48 cents. The tuning error between two frequencies $f_1$ and $f_2$ as measured in cents is defined as $$\text{cent}=(1200/\log 2)\log(f_1/f_2) \qquad \text{Eq. 2}$$

The frequency numbers represent ratios of frequencies of generated musical tones with respect to the frequency of a timing clock. A detailed description of frequency numbers is contained in U.S. Pat. No. 4,114,496 entitled "Note Frequency Generator For A Polyphonic Tone Synthesizer." This patent is hereby incorporated by reference.

The invention is first described for a four channel tone generation system. Thus each actuated keyswitch is assigned to a tone generator which, in a manner to be described below, generates four distinct and independent musical tones having a musical ensemble effect.

The frequency numbers read out of the four frequency number memories 12–15 are furnished to the associated memory address generators 20–23.

Figure 3:
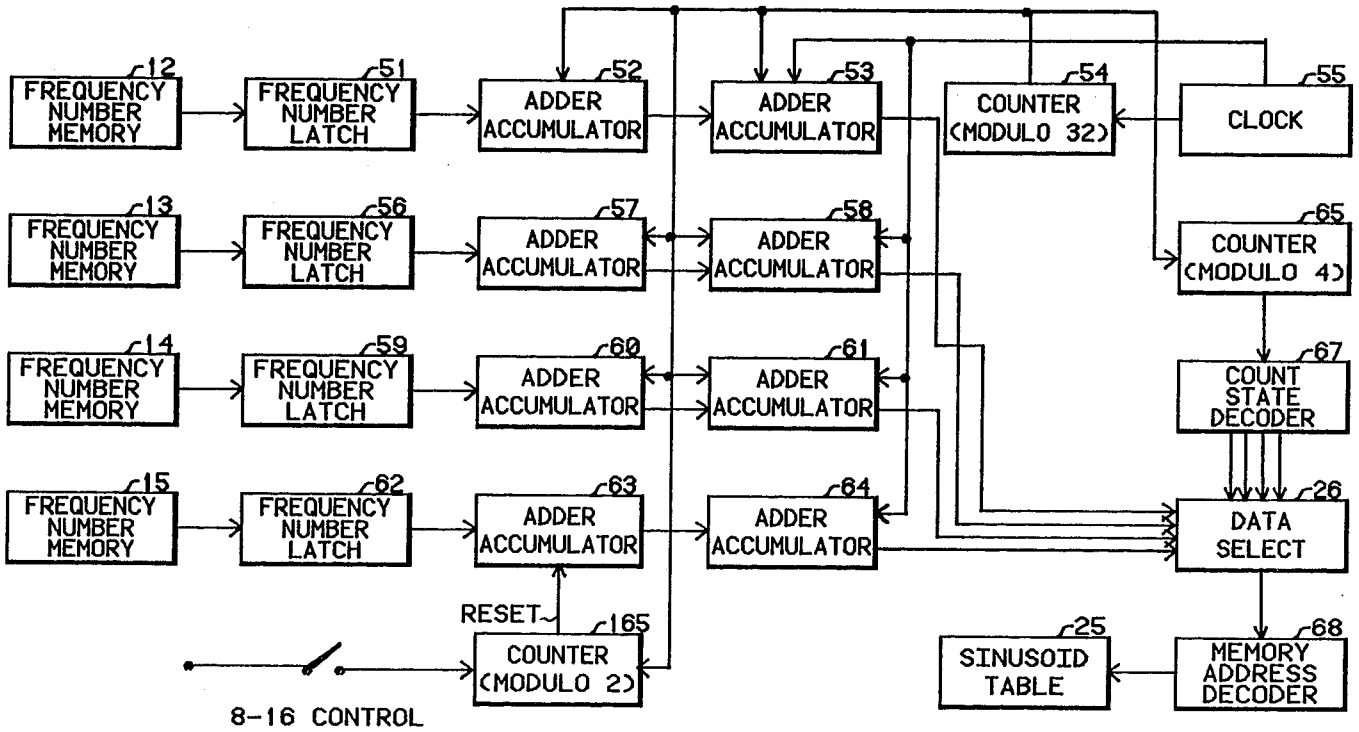
FIG. 3 is a system diagram of the memory address generators.

FIG. 3 illustrates the details of the system logic for the set of memory address generators 20–23. The invention is described for a tone generating system in which each of the generated tones has a maximum of 32 harmonics. This number is not a restriction or limitation of the invention. It is evident that the invention can be modified to accommodate any desired number for the number of maximum harmonics.

The clock 55 provides timing signals at a frequency $f_s$ where $$f_s=f_{C\#7}\times 2\times(\text{maximum no. harmonics})\times(\text{no. of tone channels})\times 32$$

where $$f_{C\#7}=2217.46\ \text{Herz}=\text{frequency of musical note } f_{C\#7}.$$

Therefore $$f_s=2217.46\times 2\times 32\times 4\times 32=18.17\ \text{MHz}.$$

The factor of 2 is needed to accommodate the Nyquist minimum frequency sampling criterion. The last factor of 32 is required because each tone channel requires 32 clock pulses to compute the contributions of its associated 32 harmonic coefficients.

The frequency number read out from the frequency number memory 12 is stored in the frequency number latch 51.

The counter 54 counts modulo 32 the timing signals produced by the clock 55. The number 32 corresponds to the maximum number of harmonics for a generated musical tone. Each time that the counter 54 is incremented so that it returns to its minimal count state because of its modulo counting implementation, a RESET signal is generated. In response to the sequence of RESET signals generated by the counter 54, the frequency number stored in the frequency number latch 51 is successively added to the content of an accumulator contained in the adder-accumulator 52. The content of the accumulator in the adder-accumulator 52 is called the accumulated sum of a frequency number. Since the frequency number contained in the frequency number latch 51 has a decimal numeric value which is less than one, the accumulated frequency number will be a decimal number having an integer portion and a decimal portion. The accumulator is the adder-accumulator 52 is implemented such that the integer portion is effectively modulo 64. This is done by allowing only 6 bits for the integer portion of the accumulated frequency number. The accumulator has a word length of $15+6=21$ bits to accommodate the 15 bit word length of the frequency number and the 6 bits for the integer portion of the accumulated frequency number.

In response to each timing signal produced by the clock 55, the accumulated frequency number contained in the adder-accumulator 52 is added to an accumulator contained in the adder-accumulator 53. The content of this accumulator is called the sinusoid argument for tone channel #1. The content of the accumulator in the adder-accumulator 53 is reset to a zero numeric value in response to the RESET signal generated by the counter 54.

In a fashion similar to that described above, the combination of the frequency number memory 13, the frequency number latch 56, the adder-accumulators 57 and 58, produce a sequence of sinusoid arguments for tone channel #2 which is contained in the accumulator contained in the adder-accumulator 58. In the same manner, the combination of the frequency number memory 14, frequency number latch 59, and adder-accumulators 60 and 61 produce a sequence of sinusoid arguments for tone channel #3.

The multi-channel tone generation system of the present invention is first illustrated for the case in which tone channels #1, #2, and #3 are operated at what is called "unison pitch" or 8-foot pitch in organ design terminology. At unison pitch, note 34 (counting from the lowest note on an organ keyboard) corresponds to the musical note $A_4$ having a frequency of 440 Hertz. The tone channel #4 is illustrated as a 16-foot pitch tone channel. Thus if the keyswitch number 34 is actuated, to musical tone one octave lower, $A_3=220$ Hertz, will be generated.

The RESET signal generated by the counter 54 is used as a timing signal to increment the counter 165. The counter 165 is implemented to counter either modulo 2 or modulo 1 in response to 8–16 CONTROL signal produced in response to the actuation of a tone control switch labeled 8–16 CONTROL. If this switch is actuated, the counter 165 will count modulo 1 and if the switch is not actuated the counter 165 will count modulo 2. Each time that the count state of the counter 165 is incremented so that it returns to its minimal count state because of its modulo counting implementation, a RESET signal is generated. In response to each RESET signal furnished by the counter 165, the frequency number held in the frequency number latch 62 is added to the content of an accumulator contained in the adder-accumulator 63. In response to each timing signal furnished by the clock 55, the content of the accumulator in the adder-accumulator 63 is added to the content of the accumulator in the adder-accumulator 64 thereby producing a sequence of sinusoid arguments for tone channel #4.

The sinusoid arguments contained in the set of adder-accumulators 53, 58, 61, and 64 are transferred to the data select 26. Counter 65 and the count state decoder 67 comprise the elements of the select data generator 70 shown in FIG. 2. The counter 65 counts the RESET signals produced by the counter 54 modulo 4. The modulo count is equal to the number of tone channels. The count state decoder 67 decodes the binary count state of the counter 65 onto four signal lines which are connected to the data select 26. In response to the signals appearing on the signal lines from the count state decoder 26, the data select 26 selects one of its input sinusoid arguments which is then transferred to the memory address decoder 68.

One implementation for the sinusoid table 25 is a ROM (read-only-memory) storing the N trigonometric sinusoid values $$\sin[\pi(2a-1)/N]$$

where a is the sinusoid argument selected by the data select 26.

The accumulators in the set of adder-accumulators 53, 58, 61 and 64 are implemented to have a 21 bit word length corresponding to the word lengths of the associated accumulators in the set of adder-accumulators 52, 57, 60 and 63.

The minimal value of N for the stored trigonometric sinusoid values is equal to 64 which corresponds to the maximum integer portion of the accumulated frequency numbers. If the choice $N=64$ is made, then the sinusoid table 25 will contain 64 trigonometric sinusoid values which are read out by the memory address decoder 68 in response to the integer portion of the sinusoid argument chosen by the data select 26.

A reduction in a residual background noise in the generated musical tones can be obtained by selecting a larger value of N. For example if $N=2\times64=128$, the sinusoid table 25 is implemented with 128 trigonometric function values. In this case the trigonometric function values are read out from the sinusoid table in response to the seven most significant bits of the sinuosoid argument chosen by the data select 26.

Figure 4:
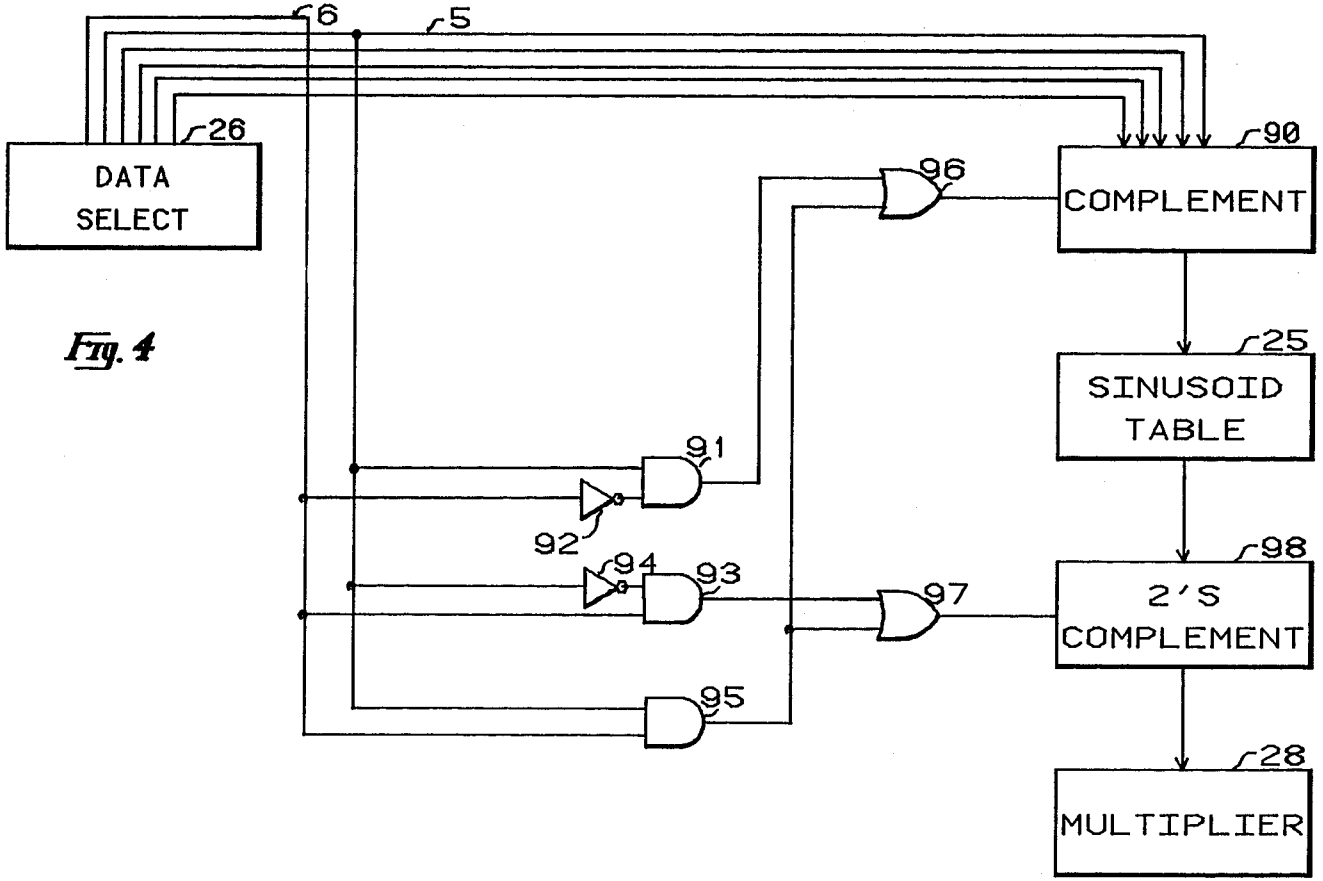
FIG. 4 is a system diagram of the memory address decoder 68.

It is not necessary to store the entire N trigonometric sinusoid function values in the sinusoid table 25. Using the well-known symmetry property of the sinusoid function, it is evident that only N/4 values are required for one-quarter period. Appropriate logic can be used to obtain values for a full period of the sinusoid function from the stored values for the one-quarter period. Such addressing logic is shown in FIG. 4.

The memory address decoder 68 logic is illustrated for the case for which $N=64$. it is immediately evident that a similar logic is readily extended for any value of N which is equal to an integral power of two. The memory address decoder 68 comprises the system elements in FIG. 4 which are labeled in the nine decade numbers with the exception of the 2's complement 98 which is interposed between the sinusoid table 25 and the multiplier 28.

Line 6 from the data select 26 contains the most significant bits of the binary formatted value of the sinusoid argument chosen by the data select 26. Line 5 contains the next most significant bit. The combination of the invertor 92 and the AND-gate 91 generates a "1" binary logic state signal if the integer portion of the selected sinusoid argument lies in the numeric range of 16–31 which corresponds to the second quadrant of the stored trigonometric sinusoid function values. The combination of the invertor 94 and the AND-gate 93 generates a "1" binary logic state signal if the integer portion of the selected sinusoid argument lies in the numeric range of 32–47 corresponding to the third quadrant of the stored trigonometric sinusoid function values. The AND-gate 95 will generate a "1" binary logic state signal if the integer portion of the selected sinusoid argument lies in the numeric range of 48–63 corresponding to the fourth quadrant of the stored trigonometric sinusoid function values.

The five least significant bits of the integer portion of the sinusoid argument value chosen by the data select 26 are furnished to the complement 90. If the OR-gate 96 furnishes a "1" logic state signal, the complement 90 performs a binary complement on its input data before it is used to form a readout address for data stored in the sinusoid table 25. The OR-gate 96 provides a "1" logic state signal if the selected sinusoid argument lies in the second or fourth quadrant. It is noted that the complement 90 forms a simple complementing of the bits and is not a 2's complement binary operation.

If the output from the OR-gate 96 is a "0" state, then the input sinusoid argument to the complement 90 is transferred unaltered to the sinusoid table 25.

In response to a "1" logic state signal from the OR-gate 97, the 2's complement 98 performs a binary 2's complement operation on the trigonometric sinusoid function read out from the sinusoid table 25 before transferring the value to the multiplier 28. If the OR-gate 97 provides a "0" logic state signal, the trigonometric sinusoid function value read out from the sinusoid table 25 is transferred unaltered to the multiplier 28. The OR-gate 97 provides a "1" logic state signal if the selected sinusoid argument lies in the third or fourth quadrant.

A preselected set of harmonic coefficients for tone channel #1 are stored in the harmonic coefficient memory 16. A preselected set of harmonic coefficients for tone channel #2 are stored in the harmonic coefficient memory 17. A preselected set of harmonic coefficients for tone channel #3 are stored in the harmonic coefficient memory 18. A preselected set of harmonic coefficients for tone channel #4 are stored in the harmonic coefficient memory 19.

The memory address decoder 100 reads out harmonic coefficients simultaneously from the harmonic coefficient memories 16–19 in response to the count state of the counter 54.

In response to the select signals generated by the select data generator 70, the data select 24 selects harmonic coefficients read out from one of the harmonic coefficient memories 16–19 which corresponds to the tone channel selected by the select data generator 70.

The harmonic coefficients selected by the data select 24 are multiplied by means of the multiplier 28 with the trigonometric sinusoid values read out from the sinusoid table 25.

The output product data produced by the multiplier 71 are multiplied by ADSR (attack/decay/sustain/-release) amplitude coefficients by means of the multiplier 71. The ADSR amplitude coefficients are provided by the ADSR generator 37. The ADSR generator creates different sets of amplitude coefficients for each of the plurality of tone channels in response to the select signals created by the select data generator 70.

A suitable configuration for the ADSR generator 37 is described in U.S. Pat. No. 4,079,650 entitled "ADSR Envelope Generator." This patent is hereby incorporated by reference.

In response to the select signals generated by the select data generator 70, the output data words from the multiplier 71 are stored in an adder-accumulator in the set of adder-accumulators 73–76 each of which is associated with one of the plurality of zone channels. The accumulators in each of the adder-accumulators 73–76 is initialized to a zero value each time the counter 54 generates a RESET signal when its count state returns to its minimal count state because of its mudulo 32 counting implementation.

Figure 5:
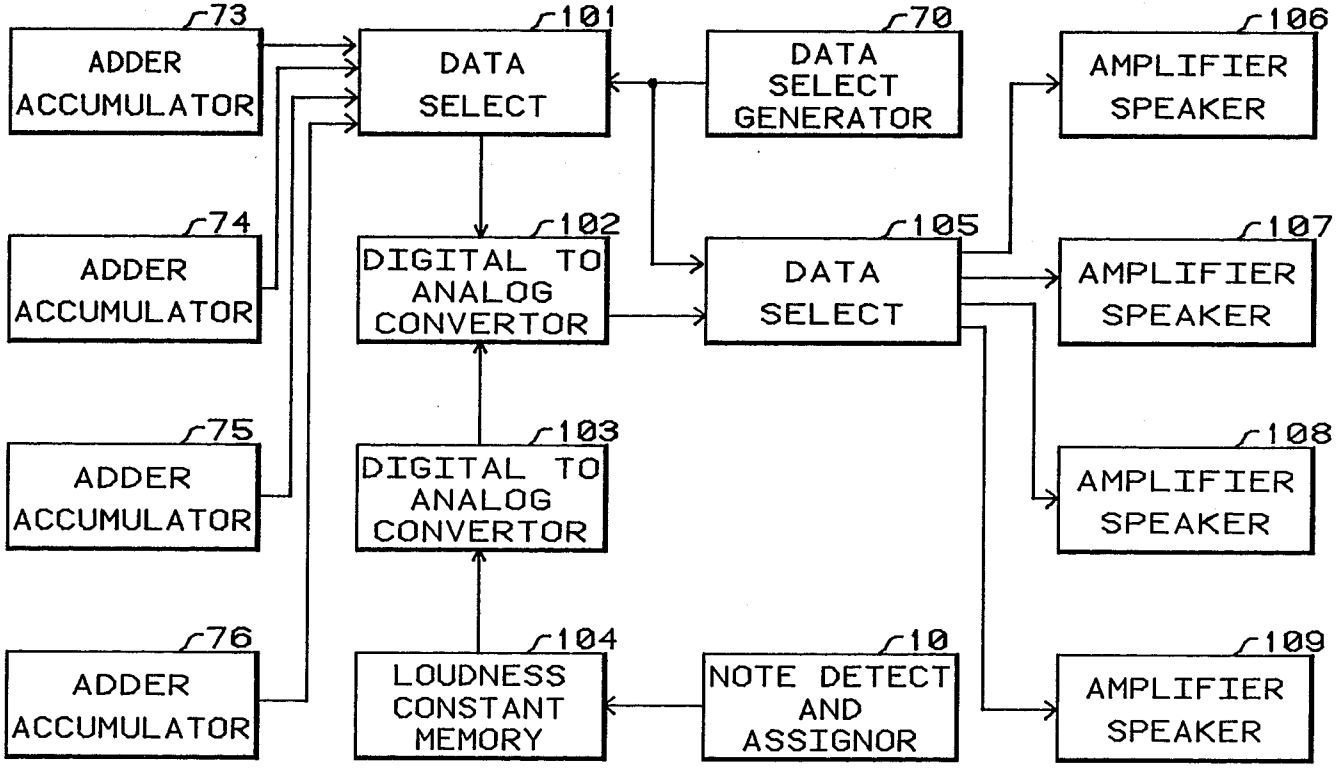
FIG. 5 is a system diagram of the sound system 77.

FIG. 5 is a system diagram of the sound system 77 which comprises all the system blocks in the 100 series numerical labels. The data select 101 transfers the content of an accumulator in the set of adder-accumulators 73–76 in response to the select signal created by the data select generator 70. The transferred data words are converted into analog signals by means of the digital-to-analog converter 102. The analog signals are directed to a corresponding amplifier-speaker by means of the data select 105. There is an amplifier-speaker in the set of amplifier-speakers 106–109. Each amplifier-speaker corresponds to one of the plurality of zone channels.

In response ot the note identification data word stored in the note detect and assignor 10, a loudness constant is read out of the loudness constant memory 104. The loudness constant, in binary numeric format, is converted into a reference analog signal by means of the digital-to-analog converter 103. The reference analog signal is used to provide the reference signal level for the digital-to-analog converter 102 thus causing it to act as a multiplying converter so that its output signal is a product of the reference signal and the binary data word furnished as an input data signal.

A discussion of loudness compensation is contained in U.S. Pat. No. 4,214,503 entitled "Electronic Musical Instrument With Automatic Loudness Compensation." This patent is hereby incorporated by reference.

An alternate method of obtaining loudness compensation is to use the ADSR generator as described in the referenced U.S. Pat. No. 4,214,503 for the ADSR generator 37.

Figure 6:
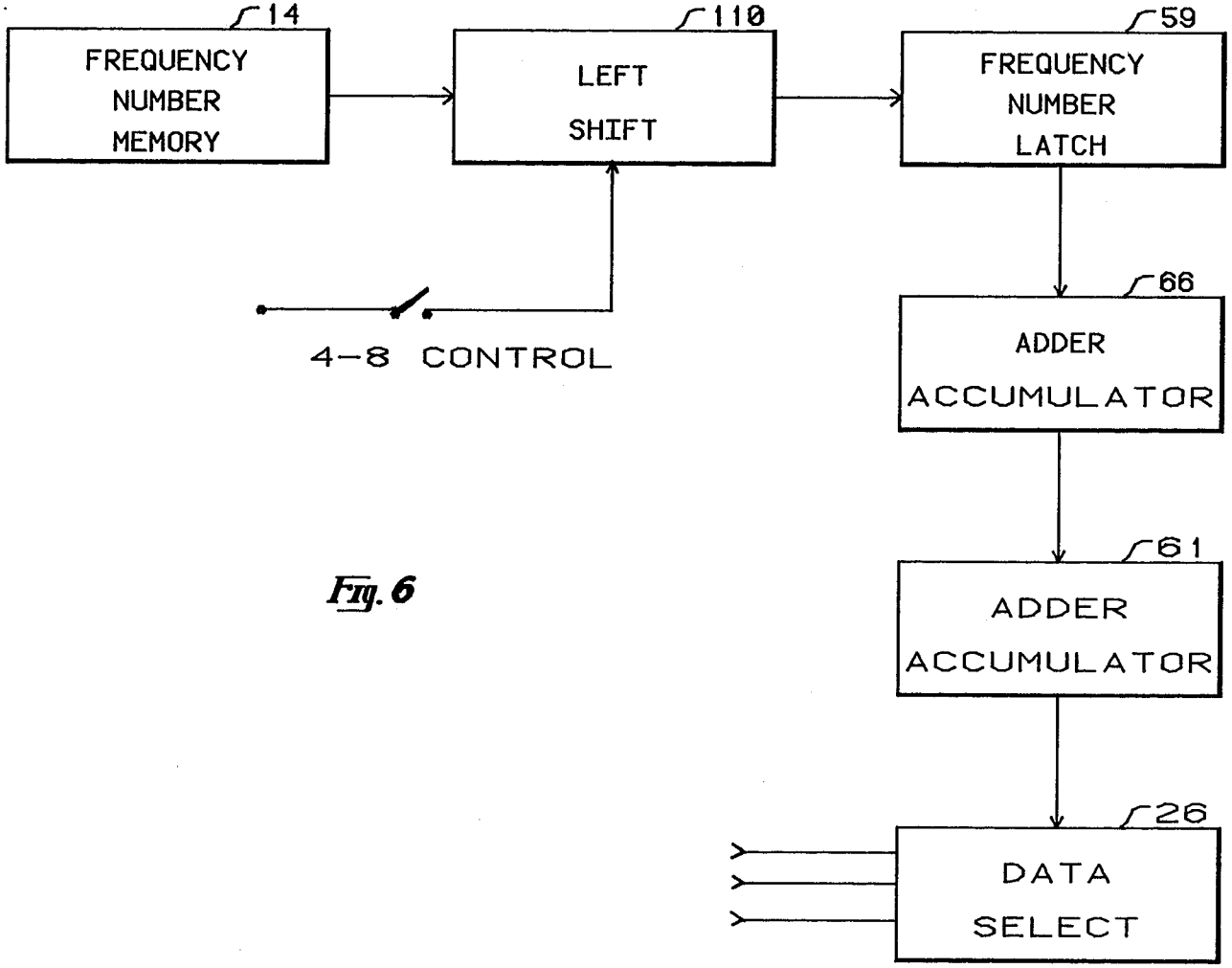
FIG. 6 is a system diagram of a 4-foot tone channel.

FIG. 6 illustrates a method of converting one of the tone channels from a nominal 8-foot pitch to a 4-foot pitch. The 4-foot pitch channel causes the generated musical tones to have a fundamental frequency which is an octave higher than the nominal frequency associated with a keyboard switch. If the 4–8 control switch is closed, the frequency number in binary numeric format read out from the frequency memory 14 is shifted one bit to the left by means of the left shift 110 before the frequency number is stored in the frequency number latch 59. The doubling of the frequency number by the left binary shift operation causes the generated musical tone to have an octave increase in its fundamental frequency.

If a multi-channel tone generation system is implemented in which one or more tone channel incorporates a 4-foot selection control, then the frequency of the clock 55 must be increased by a factor of two to prevent aliasing, or frequency folding of the higher harmonic frequencies in the generated zones.

Figure 7:
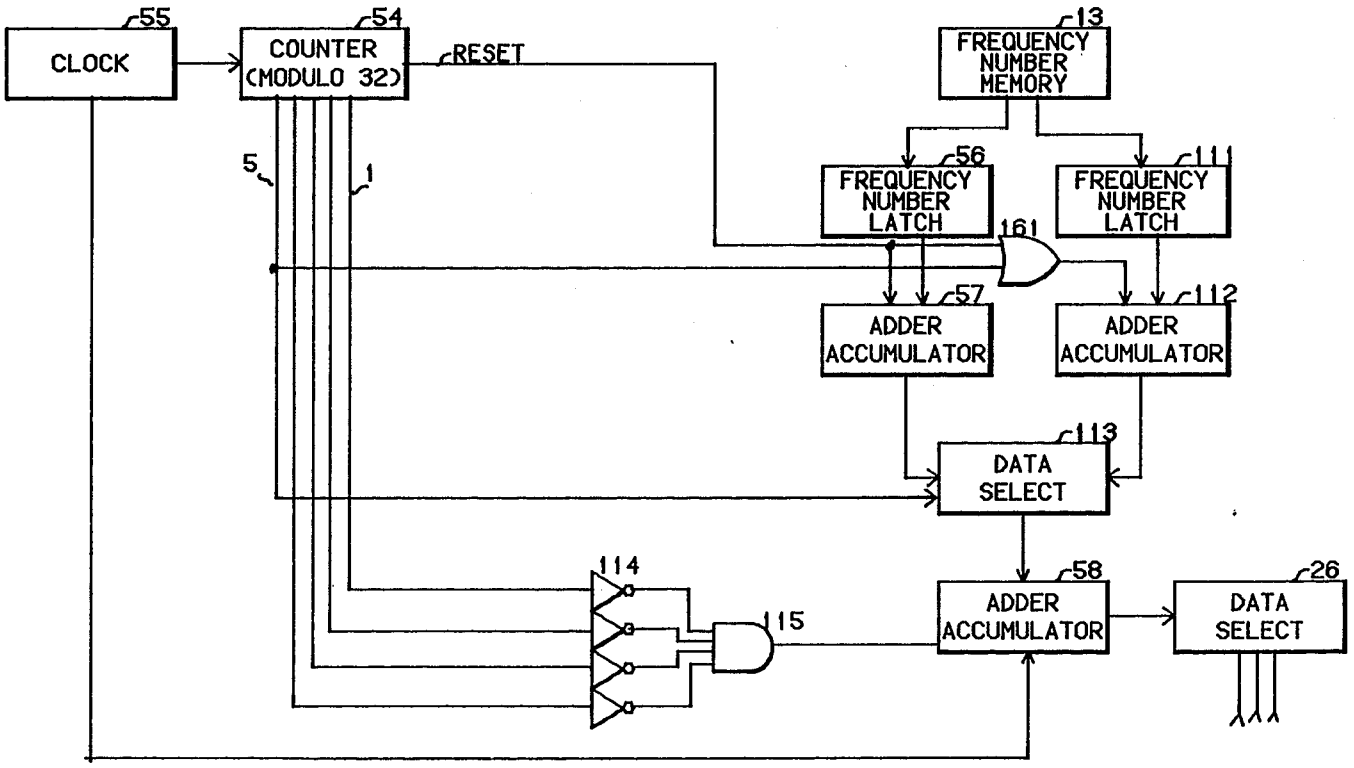
FIG. 7 is a system diagram of a combination tone channel.

Although each of the tone channels has the capability of generating musical tones having a maximum of 32 harmonics, this number of harmonics is in excess of the number of harmonics for the flute-like tones which constitute one of the more important families of organ tones. Therefore one or more of the tone channels can be implemented as a combination tone channel. An exmaple of the implementation of a combination zone channel is shown in FIG. 7 for the application in which a celeste musical effect is generated.

The celeste tones of a pipe organ are produced by a multi-rank set of pipes. One rank is set to the true musical pitch which produces tones at the nominal correct 8-foot frequencies. The second rank consists of pipes which are tuned sharp with respect to the true 8-foot frequencies. The frequency offset of the second rank of pipes is not consistent over the range of the keyboard switches, but typically ranges from about 2 Hz at $C_3$ to about 4 Hz at $C_5$. When a note is played on both ranks simultaneously, the listener perceives a pleasant beat note as the sounds from the two ranks are heard thereby giving a "warmth" to the tone. FIG. 7 illustrates an implementation of tone channel #2 as a combination tone channel in which one of the combination tone channels is used to create a celeste musical effect.

In response to a detected actuated keyswitch, the note detect and assignor 10 reads out two frequency numbers for channel #2 from the frequency number memory 13. The frequency number stored in the frequency number latch 56 is the number associated with the nominal 8-foot frequency of the actuated keyboard switch. The frequency number stored in the frequency number latch 111 is a slightly larger number and corresponds to the fundamental frequency of the frequency offset celeste tone.

Each time that the counter 54 is incremented so that it returns to its minimal, or zero, count state because of its modulo 32 count implementation, a RESET signal is generated. In response to this RESET signal, the frequency number contained in the frequency number latch 56 is added to the content of an accumulator contained in the adder-accumulator 57. Also, in response to the RESET signal, the frequency number contained in the frequency number latch 111 is added to the content of an accumulator contained in the adder-accumulator 112.

If the most significant bit of the count state which appears on line 5 is "0", then the data select 113 selects the content of the accumulator in the adder-accumulator 57. If the state of line 5 is a logic "1", then the data select 113 selects the content of the accumulator in the adder-accumulator 112.

In response to the timing signals provided by the clock 55, the adder-accumulator 58 adds the data value chosen by the data select 113 to an accumulator in the adder-accumulator 58.

The combination of the four invertor gates 114 and the AND-gate 115 generates a "1" logic state binary signal when the binary count state of the counter 54 is either "0" or "16." A "1" logic signal produced by the AND-gate 115 initializes the accumulator in the adder-accumulator 58 to a zero value. This initialization occurs before the next data value from the data select 113 is added to the accumulator.

The remainder of the multi-channel system tone generation operates in the manner already described. The first set of 16 harmonic coefficients stored in the harmonic coefficient memory 17 are preselected to correspond to the desired musical tone for the true frequency tone of the celeste tone combination. The second set of 16 preselected harmonic coefficients, 17–32, are preselected to correspond to the desired musical tone for the frequency offset tone of the celeste tone combination.

An alternative system configuration can be used to divide the total number of harmonics between the two celeste channels. For example, the bit state lines from the counter 54 can be decoded to provide a reset signal to the adder-accumulator 112 and a select signal to the data select 113 for any preselected count state of the counter 54.

It is obvious that if each of the tones generated by the multi-channel tone generation is created with a maximum of 32 harmonics, then many of the harmonic overtones of the fundamental frequency will lie well above the high frequency response of the human ear. For example the 32nd harmonic of the note $C_7$ has a frequency of 66.98 KHz. The upper limit of frequencies can be set at some lower number such as 16 KHz. The use of harmonic limiting can result in a lowering of the computation speed required to compute the amplitudes of the musical waveshape data words as well as in the speed required by the digital-to-analog converters used to convert the binary waveshape data words into analog signals.

Table 1 lists the range of musical frequencies for the 61 notes comprising a standard organ keyboard. The highest harmonic is listed whose frequency does not exceed 16 KHz.

TABLE 1

| Note | Frequency | Maximum frequency | Maximum No. Harmonics |
|---|---|---|---|
| C2 | 65.41 | 2093.00 | 32 |
| C#2 | 69.30 | 2217.46 | 32 |
| D2 | 3.42 | 2349.32 | 32 |
| D#2 | 77.78 | 2489.02 | 32 |
| E2 | 82.41 | 2637.02 | 32 |
| F2 | 87.31 | 2793.83 | 32 |
| F#2 | 92.50 | 2960.00 | 32 |
| G2 | 98.00 | 3135.96 | 32 |
| G#2 | 103.83 | 3322.44 | 32 |
| A2 | 110.00 | 3520.00 | 32 |
| A#2 | 116.54 | 3729.31 | 32 |
| B2 | 123.47 | 3951.05 | 32 |
| C3 | 130.81 | 4186.01 | 32 |
| C#3 | 138.59 | 4434.92 | 32 |
| D3 | 146.83 | 4698.64 | 32 |
| D#3 | 155.56 | 4978.03 | 32 |
| E3 | 164.81 | 5274.04 | 32 |
| F3 | 174.61 | 5587.65 | 32 |
| F#3 | 185.00 | 5919.91 | 32 |
| G3 | 196.00 | 6271.93 | 32 |
| G#3 | 207.65 | 6644.88 | 32 |
| A3 | 220.00 | 7040.00 | 32 |
| A#3 | 233.08 | 7458.62 | 32 |
| B3 | 246.94 | 7902.13 | 32 |
| C4 | 261.63 | 8372.02 | 32 |
| C#4 | 277.18 | 8869.84 | 32 |
| D4 | 293.66 | 9397.27 | 32 |
| D#4 | 311.13 | 9956.06 | 32 |
| E4 | 329.63 | 10548.08 | 32 |
| F4 | 349.23 | 11175.30 | 32 |
| F#4 | 369.99 | 11839.82 | 32 |
| G4 | 392.00 | 12543.85 | 32 |

TABLE 1-continued

| Note | Frequency | Maximum frequency | Maximum No. Harmonics |
|---|---|---|---|
| G#4 | 415.30 | 13289.75 | 32 |
| A4 | 440.00 | 14080.00 | 32 |
| A#4 | 466.16 | 14917.24 | 32 |
| B4 | 493.88 | 15804.27 | 32 |
| C5 | 523.25 | 15697.53 | 30 |
| C#5 | 554.37 | 15522.23 | 28 |
| D5 | 587.33 | 15857.90 | 27 |
| D#5 | 622.25 | 15556.35 | 25 |
| E5 | 659.26 | 15822.12 | 24 |
| F5 | 698.46 | 15366.04 | 22 |
| F#5 | 740.00 | 15539.76 | 21 |
| G5 | 783.99 | 15679.82 | 20 |
| G#5 | 830.61 | 15781.58 | 19 |
| A5 | 880.00 | 15840.00 | 18 |
| A#5 | 932.33 | 15849.57 | 17 |
| B5 | 987.77 | 15804.27 | 16 |
| C6 | 1046.50 | 15697.53 | 15 |
| C#6 | 1108.73 | 15522.23 | 14 |
| D6 | 1174.66 | 15270.57 | 13 |
| D#6 | 1244.51 | 14934.09 | 12 |
| E6 | 1318.51 | 15822.12 | 12 |
| F6 | 1396.91 | 15366.04 | 11 |
| F#6 | 1479.98 | 14799.78 | 10 |
| G6 | 1567.98 | 15679.82 | 10 |
| G#6 | 1661.22 | 14950.97 | 9 |
| A6 | 1760.00 | 15840.00 | 9 |
| A#6 | 1864.66 | 14917.24 | 8 |
| B6 | 1975.53 | 15804.27 | 8 |
| C7 | 2093.00 | 14651.03 | 7 |

Figure 8:
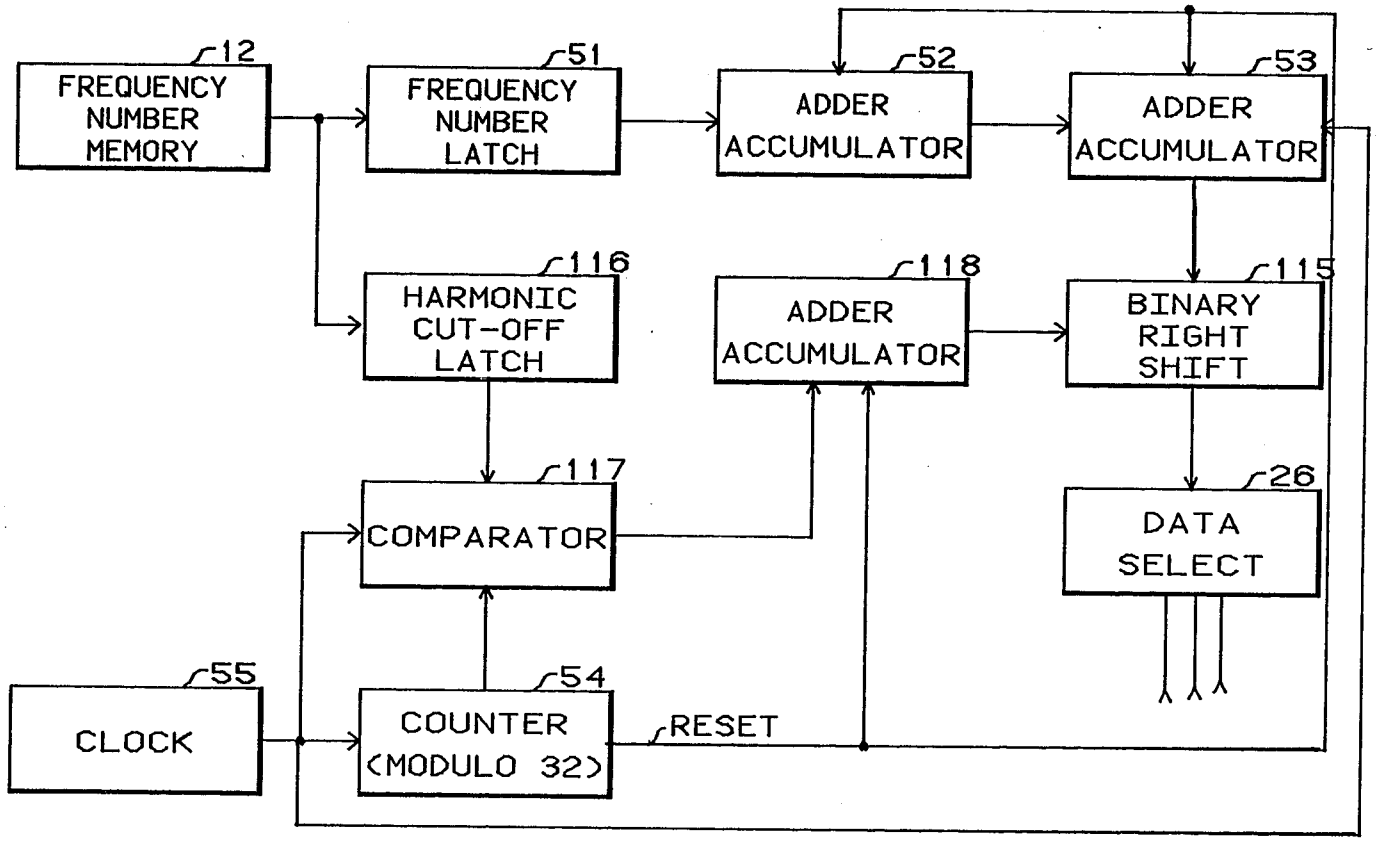
FIG. 8 is a system diagram of a harmonic limited tone channel.

FIG. 8 illustrates a subsystem for harmonic limiting. For illustrative purposes the subsystem is drawn for tone channel #1 although it is understood that a similar subsystem could be incorporated into the other tone channels. A feature of the harmonic limiting subsystem is that the harmonic contributions are not abruptly inhibited but are tapered so that the musical tones vary smoothly throughout the frequency range of the instrument's keyboard.

The maximum harmonic listed in the last column of Table 1 is encoded as the five least significant bits of the frequency number stored in the frequency number memory. When a frequency number is read from the frequency number memory 12, the five least significant bits are removed before the frequency number is stored in the frequency number latch 51. Only the five least significant bits of the frequency number read from the frequency number memory 12 are stored in the harmonic cutoff latch 116.

In response to each timing signal produced by the clock 55, the comparator 117 compares the count state of the counter 54 with the cutoff harmonic number stored in the harmonic cutoff latch 116. If the count state of the counter 54 is greater than the cutoff harmonic number, the comparator 117 generates a binary "1" logic state signal which is added to the content of an accumulator contained in the adder-accumulator 118.

The binary right shift 115 shifts the value contained in the accumulator of the adder-accumulator 53 a number of right shifts which is equal to the number stored in the adder-accumulator 118. The right shifted sinusoid argument from the binary right shift 115 is furnished to the data select 26.

The accumulator in the adder-accumulator 118 is initialized to a zero value in response to the RESET signal generated by the counter 54.

The net result of the harmonic limiting subsystem shown in FIG. 8 is that sinusoid argument is successively forced to a zero value for harmonic numbers greater than the harmonic cutoff number. This is done in a gradual manner rather than by an abrupt inhibition of harmonic frequency components.

Figure 9:
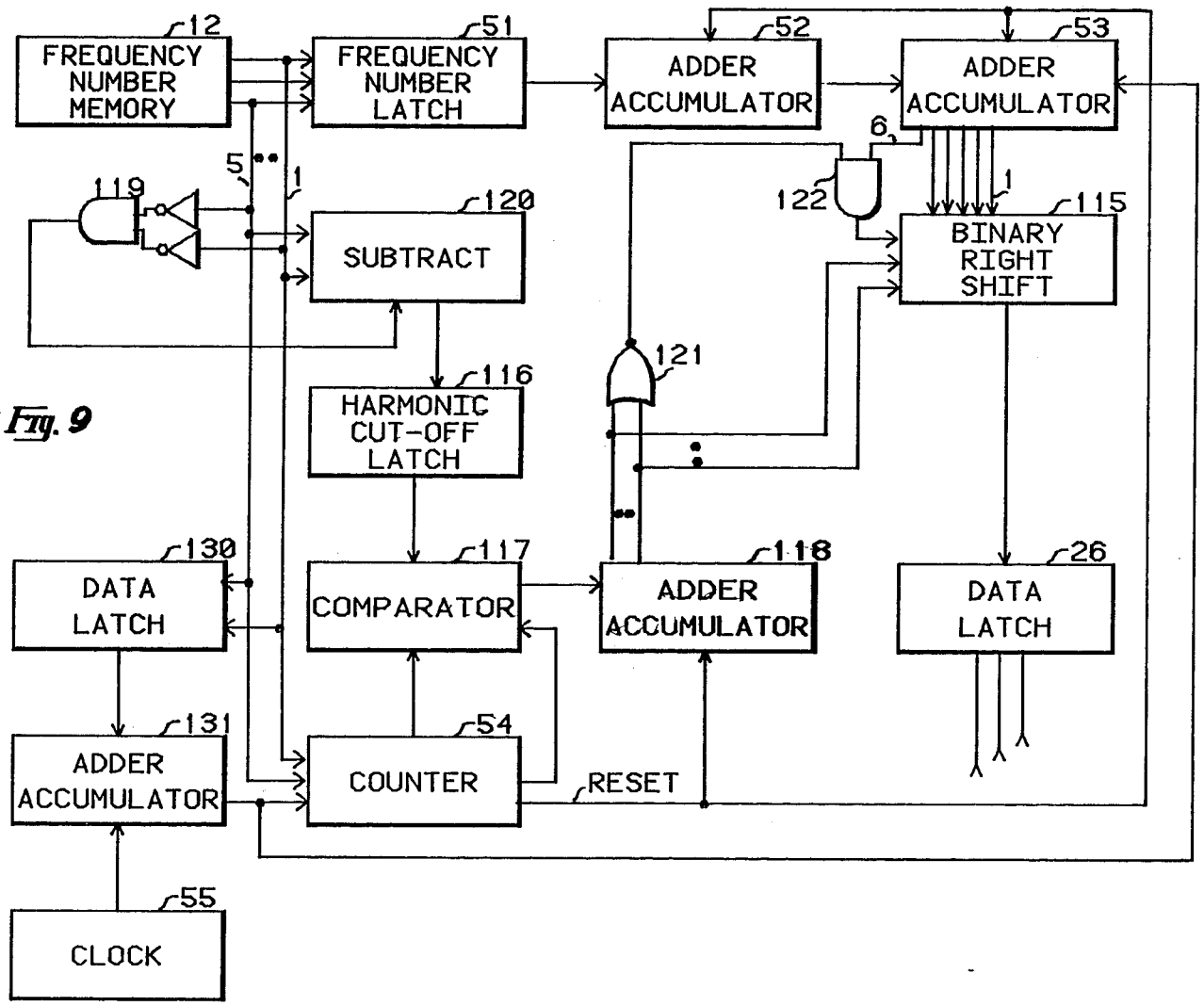
FIG. 9 is a system diagram of an alternative implementation of a harmonic limiting subsystem.

FIG. 9 shows an alternative implementation of a harmonic limiting subsystem. The five least significant bits of the frequency number read out of the frequency number memory 12 are furnished to the subtract 120. As described previously, the five least significant numbers of the frequency number stored in the frequency number memory 12 are used to indicate the cutoff harmonic number.

The subtract 120 subtracts a predetermined integer number from the harmonic cutoff number if the output state from the invertor-AND-gate combination 119 is a logic "0" binary signal state. The gate combination 119 provides a "1" state signal if all of the bits of the harmonic cutoff number have a "1" state. The "1" state signal signifies a harmonic cutoff number of the full range of 32 harmonics. In this case there will be no harmonic limiting.

The subtract 120 can advantageously be implemented to subtract a numeric constant of either two or three depending upon the desired harmonic limiting action which starts before the actual value of the harmonic cutoff number.

The comparator 117 compares the count state of the counter 117 with the modified harmonic cutoff number which is stored in the harmonic cutoff latch 116 for each timing signal provided by the clock 55. If the count state of the counter 117 is greater than the modified harmonic cutoff number, a "1" signal is generated by the comparator 117. The "1" signals provided by the comparator 117 are added to the contents of an accumulator contained in the adder-accumulator 118.

The binary right shift 115 shifts the value transferred from the accumulator in the adder-accumulator 53 a number of right bit shifts which is equal to the number stored in the adder-accumulator 118. The right shifted sinusoid argument for the binary right shift 115 is furnished to the data select 26.

The accumulator in the adder-accumulator 118 is initialized to a zero value state in response to the RESET signal generated by the counter 54.

The five bits of the accumulator contained in the adder-accumulator 118 are connected to NOR-gate 121. If a bit has a "1" logic state then a "0" state signal is furnished to the AND-gate 122. Such a "0" signal forces the AND-gate 122 to place a "0" value for the most significant bit of the sinusoid argument value transferred from the adder-accumulator 53 to the binary right shift 115. The net result is that at the start of a harmonic limiting sequence, the sinusoid argument presented to the data select 26 is immediately shifted to a first quadrant sinusoid argument so that the subsequent shifted sinusoid arguments all are first quadrant values.

To take full advantage of the ability to reduce the calculation speed when a harmonic limiting subsystem is incorporated into the multi-channel tone generating system, a means is inserted which varies the effective clock speed as a function of the harmonic cutoff number. This computation speed variation is accomplished using the system logic shown in FIG. 9.

The harmonic cutoff number furnished by the five least significant bits of the frequency number read out from the frequency number memory 12 is stored in the data latch 130. In response to each timing signal provided by the clock 55, the harmonic cutoff number stored in the data latch 130 is added to the content of an accumulator contained in the adder-accumulator 131. This accumulator has a word length of five binary bits. Each time that the accumulator over flows because of its word length restriction, a timing signal is generated. The generated timing signal is provided to the counter 54 and the adder-accumulator 53. This timing signal replaces the timing signal that previously had been furnished directly by the clock 55.

The counter 54 is implemented to count modulo the harmonic cutoff number read out from the frequency number memory 12.

In the above fashion, the tone generation is made adaptive in time to the maximum number of harmonics which has been prespecified for each musical note.

Figure 10:
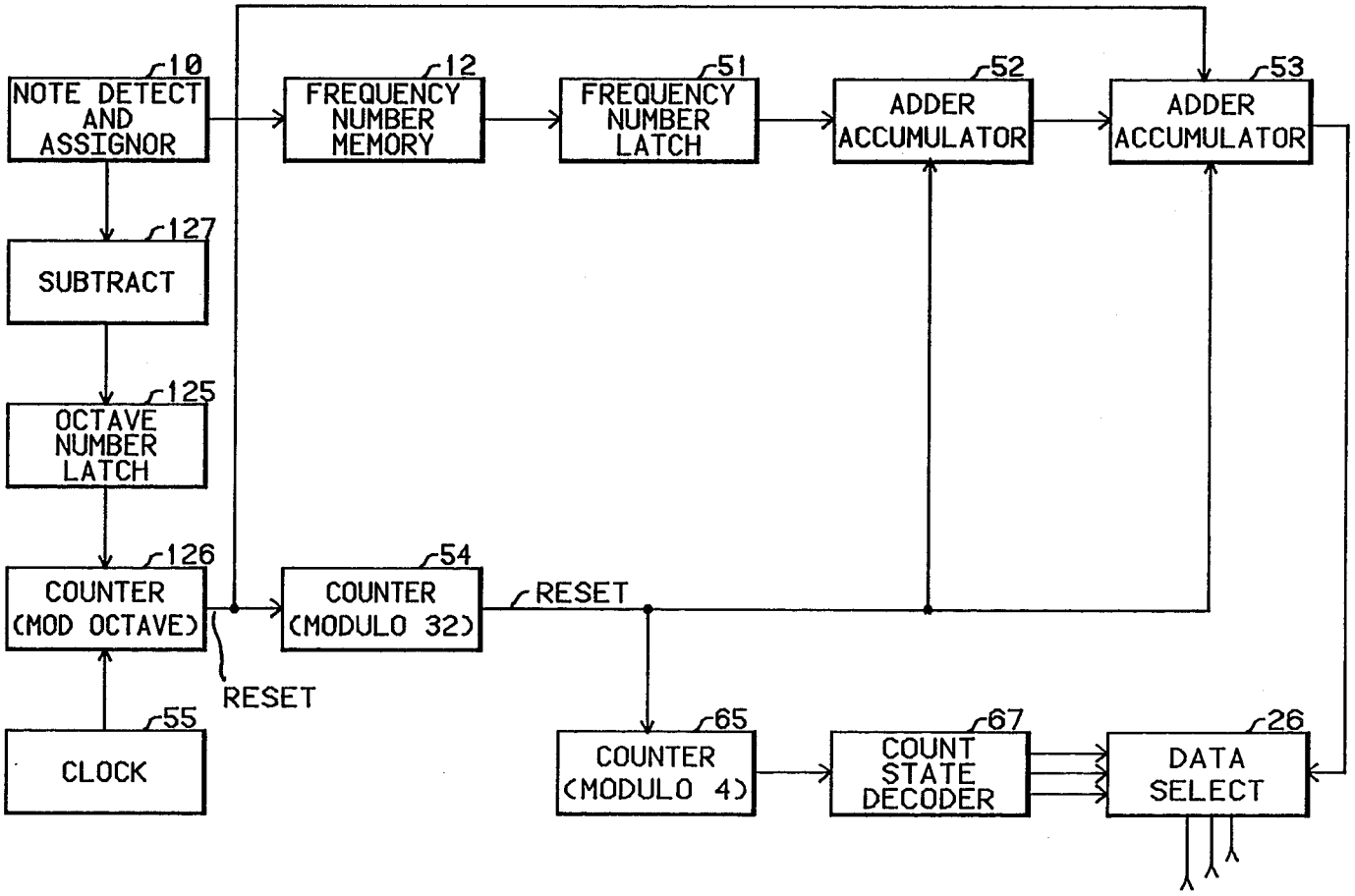
FIG. 10 is a system diagram of an octave timing clock.

FIG. 10 illustrates a modification of the basic computation clock which has the desirable attribute of reducing the number of bits in the frequency number binary word required to obtain a prespecified frequency accuracy. Because of the octave relations, a 15 bit frequency number for the highest keyboard frequency at $C_7$ reduces to a 14 bit number accuracy for the octave 6 ($C_6$-$B_6$); reduces to 13 bit number accuracy for the octave 5 ($C_5$-$B_5$); reduces to a 12 bit number accuracy for the octave 4 ($C_4$-$B_4$); reduces to an 11 bit number accuracy for the octave 3 ($C_3$-$B_3$); and to a 10 bit number accuracy for the octave 2 ($C_2$-$B_2$).

Frequency numbers all having a 10 bit word length can be used in the system configuration illustrated in FIG. 10. This system operates by dividing the timing clock frequencies for each octave instead of relying solely upon the frequency number itself to determine the generated musical tone's fundamental frequency.

Each actuated keyswitch which is detected by the note detect and assignor 10 causes an identification data word to be encoded and stored in an assignment memory contained within the note detect and assignor 10. This encoding identifies the corresponding actuated keyswitch by the keyboard, octave, and musical note within the octave.

When a multi-channel tone generator is assigned to an actuated keyswitch, the corresponding octave number is provided to the subtract 127. The subtract 127 subtracts a constant numerical value of 6 from the octave number and the result is stored in the octave number latch 125. The counter 126 counts the timing signals provided by the clock 55 modulo the number contained in the octave number latch 125. Each time that the counter 126 returns to its minimal count state because of its modulo counting implementation a RESET signal is generated. The sequence of RESET signals generated by the counter 126 serve as the timing signals for the remainder of the system logic elements replacing the clock signals previously shown as coming directly from the clock 55.

Instead of storing the trigonometric sinusoid function values sin [(2a-1)/N] in the sinusoid table 25, the trigonometric function values cos [(2a-1)/N] could also serve as to the stored values.

It is well-known in the mathematical art that for a period of a waveshape, such as that occurring in musical tones, generalized harmonic series synthesis can be used to computationally synthesize such waveshapes. The use of generalized harmonic series synthesis in a musical tone generation system is described in U.S. Pat. No. 4,085,644 entitled "Polyphonic Tone Synthesizer." This patent is hereby incorporated by reference.

The generalized harmonic series for synthesizing waveshape data points $z_n$ can be written in the form $$z_n = \Sigma_q a_q \phi_q(n);\ n = 1, 2, 3, \qquad \text{Eq. 4}$$

where $\phi_q(n)$ denotes any member of the family of orthogonal functions or orthogonal polynomials. By analogy with conventional Fourier series, the coefficients $a_q$ are called generalized Fourier harmonic coefficients. The orthogonal polynomials include those of Legendre, Gengenbauer, Jacobi, and Hermite polynomials. The orthogonal functions include those of Walsh, Bessel and the conventional trigonometric. The values of the orthogonal polynomials, or orthogonal functions are stored in the sinusoid table 25 and the generalized harmonic coefficients are stored in the harmonic coefficient memories 16–19.

Figure 11:
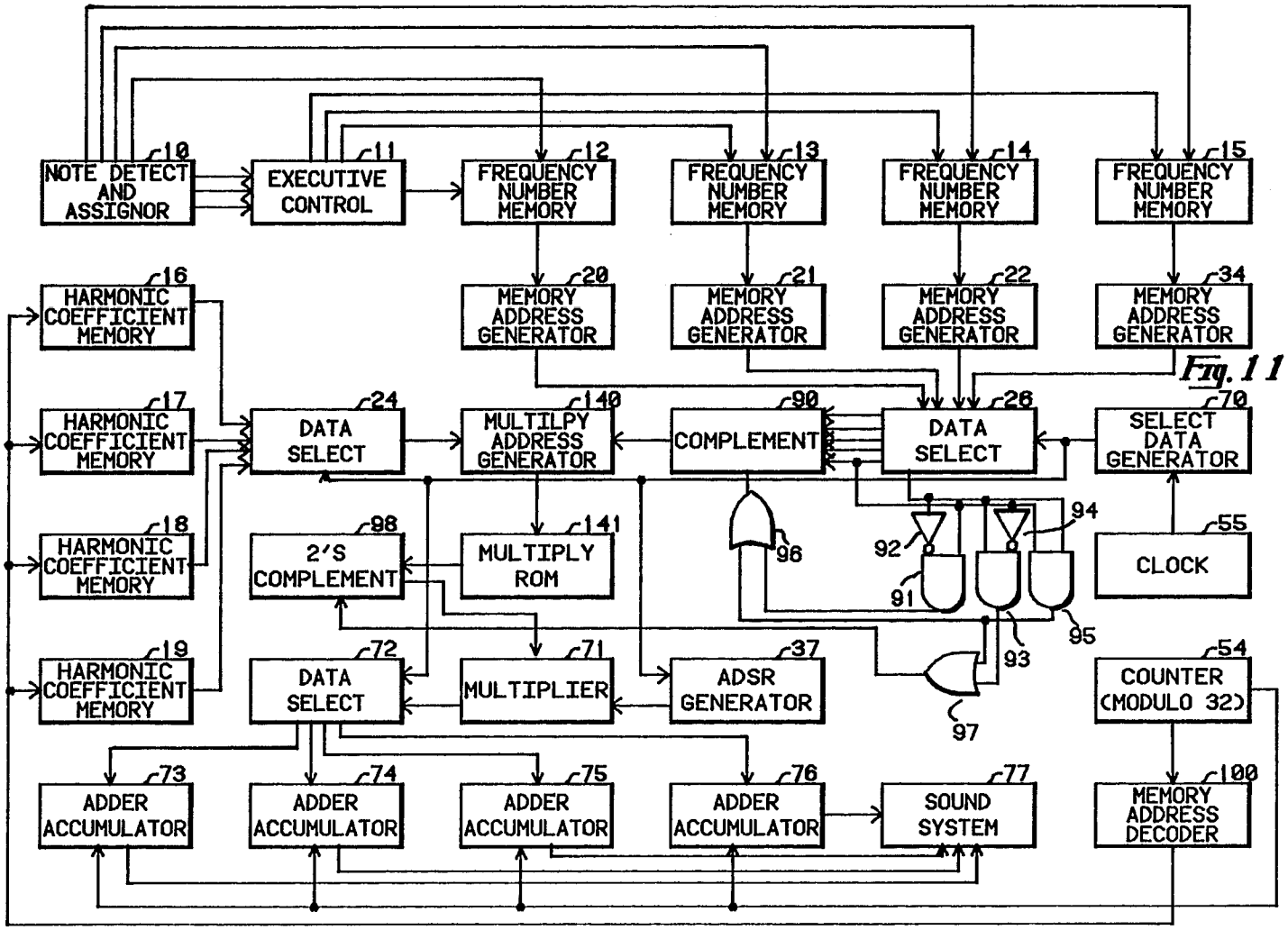
FIG. 11 is a system diagram of an alternate embodiment of a tone generator.

FIG. 11 illustrates an alternate embodiment of a tone generator. In this embodiment the sinusoid table 25 and multiplier 28 shown for the system shown in FIG. 2 are replaced by a read only memory, multiply ROM 141. In addition the four quadrant detection scheme shown in FIG. 4 is included tp reduce the number of data words which must be stored in the multiply ROM 141.

To simplify the memory addressing for the multiply ROM 141, the harmonic coefficients stored in the set of harmonic coefficient memories 16–17 are stored as integer DB values in the range of −0 to −31. Since all the DB values are negative, the negative sign is not required so that the DB values are stored as positive integers. The range of 0 to 31 DB is sufficient to describe the spectral contributions of most musical tones. These numbers are stored as a data word having five bits.

The system operates in the same manner as that previously described for the system shown in FIG. 2 until the output data from the data select 26 is reached. In the manner previously described for a single quadrant sinusoid table illustrated in FIG. 4, the AND-gate 91 and the AND-gate 95 will have a logic "1" output state if the six most significant bits of the sinusoid argument selected by the data select 26 corresponds to an angle lying in the second or fourth quadrant. If this "1" bit is generated, then the complement is formed for the 5 least significant bits of the sinusoid argument by the complement 90.

The multiply address generator 140 generates a multiply address number by forming a data word whose five most significant bits are the harmonic coefficient value selected by the data select 24 and whose five least significant bits are those for the data value furnished by the complement 90.

The multiply address is used to read out a corresponding product value for the multiply ROM 141. If either the AND-gate 93 or the AND-gate 95 has a logic "1" output state then a "1" state signal is sent to the 2's complement 98. In response to an input "1" signal, the 2's complement operation on the data value read from the multiply ROM 141 before the value is transferred to the multiplier 71.

The remainder of the tone generation system operates in the same manner as the system shown in FIG. 2 and which has been previously described.

The data values D stored in the multiply ROM 141 are computed from the relation $$D = \exp(-2.3d/20) \sin[\pi(2a-1)/n]$$

where d is a DB value in the range of 0 to 31 and a is a sinusoid argument in the range of 0 to 31.

I claim:

1. In combination with a keyboard operated musical instrument having an array of keyswitches capable of being actuated and having a plurality of tone generators, apparatus for simultaneously producing a plurality of musical tones having an ensemble effect in response to each actuated keyswitch comprising;

an assignor means for generating a detect data word in response to each actuated keyswitch in said array of keyswitches and for assigning one of a said plurality of tone generators to each said actuated keyswitch and for providing an associated detect data word to a corresponding assigned tone generator in said plurality of tone generators, a frequency number generating means for providing to each said assigned tone generator a plurality of frequency numbers in response to said associated detect data word provided to each said assigned tone generator wherein each one of said plurality of frequency numbers has an individual prespecified offset numerical value; and said plurality of tone generators each of which comprises;

a plurality of harmonic coefficient memory means for storing a plurality of sets of harmonic coefficients wherein each one of said harmonic coefficient memory means is associated with a corresponding one of said plurality of musical tones and stores one set of harmonic coefficients of said plurality of sets of harmonic coefficients, a harmonic memory addressing means for reading out said harmonic coefficients from said plurality of harmonic coefficient memory means, a computing means for continuously computing in real time a plurality of sequences of waveshape data words wherein each sequence of waveshape data words in said plurality of of sequences of waveshape data words is computed in a cyclic order and wherein said computing is in response to said harmonic coefficients read out from said plurality of harmonic coefficient memory means and in response to said plurality of frequency numbers provided to an assigned tone generator in said plurality of tone generators, and a conversion means for combining said plurality of sequences of data words and for producing said plurality of musical tones having an ensemble effect.

2. Apparatus according to claim 1 wherein said frequency number generating means comprises:

a plurality of frequency number memories each of which is associated with a corresponding one of said plurality of musical tones having an ensemble effect and each of which stores a set of frequency numbers, and a frequency number addressing means for reading out a frequency number from each of said plurality of frequency number memories in response to said detect data word provided to said assigned tone generator.

3. Apparatus according to claim 1 wherein said computing means comprises;

a clock for providing timing signals, a first counter having a plurality of count states for counting said timing signals modulo the number of harmonic coefficients stored in each one of said harmonic coefficient memory means and wherein a reset signal is generated each time that said first counter returns to its minimal count state, a plurality of accumulated frequency number generators each of which generates an accumulated frequency number in response to a corresponding one of said frequency numbers provided to said assigned tone generator, a plurality of adder-accumulator means, each one of which comprises an accumulator, and each one of which in response to said reset signal successively adds an accumulated frequency number generated by said plurality of frequency number generators to the content of its corresponding said accumulator thereby creating a sinusoid argument data value in each one of said plurality of adder-accumulator means, a second counter having a plurality of count states for counting each said reset signal modulo the number of said plurality of musical tones, a first data select means for selecting one of said sinusoid argument data values from said plurality of adder-accumulator means in response to count states of said second counter, a sinusoid table for storing a plurality of trigonometric sinusoid function values, a sinusoid addressing means for reading out a trigonometric sinusoid function value from said sinusoid table in response to said sinusoid argument data value selected by said first data select means, a second data select means for selecting harmonic coefficients read out from said plurality of harmonic coefficient memory means in response to count states of said second counter, a first multiplying means for multiplying said harmonic coefficient values selected by said second data select means with said trigonometric sinusoid function value read out from said sinusoid table to form product data values, a plurality of tone producing means each of which is associated with a corresponding one of said plurality of musical tones wherein said plurality of musical tones is generated in response to said product data values created by said first multiplying means, and a third data select means for selectively providing said product data values to one of said plurality of tone producing means in response to count states of said second counter.

4. Apparatus according to claim 3 wherein each one of said plurality of accumulated frequency number generators comprises;

a frequency number latch for storing a corresponding one of said frequency numbers provided to said assigned tone generator, and a frequency number adder-accumulator means, comprising an accumulator, wherein in response to said reset signal the frequency number contained in said frequency number latch is successively added to said accumulator thereby creating said accumulated frequency number.

5. Apparatus according to claim 3 wherein each one of a subset of said plurality of accumulated frequency number generators comprises;

a frequency number latch for storing a corresponding one of said frequency numbers provided to said assigned tone generator, a division counter for counting each of said reset signals modulo 2 and wherein a division reset signal is generated each time that said division counter returns to its minimal count state, and a frequency number adder-accumulator means, comprising a frequency number accumulator, wherein in response to said division reset signal, the frequency number contained in said frequency number latch is successively added to said frequency number accumulator thereby creating said accumulated frequency number corresponding to a musical tone having a nominal fundamental frequency an octave lower than the note associated with the corresponding actuated keyswitch for said assigned tone generator.

6. Apparatus according to claim 3 wherein said computing means further comprises;

an ADSR envelope function generator responsive to the count state of said second counter wherein a plurality of ADSR envelope function values are generated in response to said detect data word provided to the corresponding said assigned tone generator and wherein each one of said plurality of ADSR envelope function values corresponds to an associated one of said plurality of musical tones, and a second multiplying means interposed between said first multiplying means and said plurality of tone producing means for multiplying said product values created by said first multiplying means by said ADSR envelope function values generated by said ADSR envelope function generator.

7. Apparatus according to claim 3 wherein said third data select means comprises;

a loudness constant memory for storing a set of loudness constants, a loudness addressing means for reading out a loudness constant from said loudness constant memory in response to said detect data word provided to the corresponding said assigned tone generator, and a first conversion means for converting said loudness constant read out from said loudness constant memory to a loudness control signal and for providing said loudness control signal to said plurality of tone producing means.

8. Apparatus according to claim 7 wherein said plurality of tone producing means comprises;

a plurality of tone adder-accumulator means, each of which comprises a tone accumulator, for successively adding said product values to said tone accumulator in response to data selectively provided by said third data select means, a fourth data select means for selecting the content of one of said tone accumulators in a corresponding one of said plurality of tone adder-accumulator means in response to the count state of said second counter, a second conversion means responsive to said loudness control signal for converting the data value contained in said accumulator selected by said fourth data select word into a scaled analog signal, a plurality of transducers each of which produces an audible musical sound in response to said scaled analog signal, and a fifth data select means for providing said scaled analog signal to one of said plurality of transducers in response to the count state of said second counter.

9. In combination with a keyboard operated musical instrument having an array of keyswitches capable of being actuated and having a plurality of tone generators, apparatus for simultaneously producing a plurality of musical tones having an ensemble effect and an musical tone having a celeste effect in response to each actuated keyswitch comprising;

an assignor means for generating a detect data word in response to each actuated keyswitch in said array of keyswitches, for assigning one of said plurality of tone generators to each said actuated keyswitch and, for providing an associated detect data word to a corresponding assigned tone generator in said plurality of tone generators, a frequency number generating means for providing to each said assigned tone generator a plurality of frequency numbers in response to said associated detect data word provided to each said assigned tone generator wherein each one of said plurality of frequency numbers has an individual offset numerical value, and;

said plurality of tone generators each of which comprises;

a plurality of harmonic coefficient memory means for storing a plurality of sets of harmonic coefficients wherein each one of said plurality of harmonic coefficient memory means is associated with a corresponding one of said plurality of musical tones and stores one set of harmonic coefficients of said plurality of harmonic coefficients, a celeste harmonic coefficient memory means for storing a first set of tone harmonic coefficients and for storing a second set of celeste harmonic coefficients, a harmonic memory addressing means for simultaneously reading out harmonic coefficients from said plurality of harmonic coefficient memory means and from said celeste harmonic coefficient memory means, a computing means for computing in real time a plurality of sequences of waveshape data words wherein each sequence of waveshape data words is computed in response to said plurality of frequency numbers provided to said assigned tone generator wherein a sequence of waveshape data words in said plurality of sequences of waveshape data words is computed in response to a corresponding set of harmonic coefficients read out from said plurality of harmonic coefficient memory means and wherein a sequence of waveshape data words is computed in response to said first set of tone harmonic coefficients and in response to said second set of celeste harmonic coefficients read out from said celeste harmonic coefficient memory, and a conversion means for combining said plurality of sequences of waveshape data words and for producing said plurality of musical tones having an ensemble effect and for producing a musical tone having a celeste effect.

10. Apparatus according to claim 9 wherein said frequency number generating means comprises;

a plurality of frequency number memory means for storing sets of frequency numbers and wherein each one of said plurality of frequency number memory means is associated with a corresponding one of said plurality of musical tones having an ensemble effect, a first celeste frequency number memory means for storing a set of first celeste frequency numbers and wherein said first celeste frequency number means is associated with said musical tone having a celeste effect, a second celeste frequency number memory means for storing a set of second celeste frequency numbers and wherein said second celeste frequency number means is associated with said musical tone having a celeste effect, and a frequency number addressing means, responsive to said detect data word provided to said assigned tone generator for reading out a frequency number from each of said plurality of frequency number memory means, for reading out a first celeste frequency number from said first celeste frequency number memory means, and for reading out a second celeste frequency number from said second celeste frequency number memory means.

11. Apparatus according to claim 10 wherein said computing means comprises;

a clock for providing timing signals, a first counter means having a plurality of count states for counting said timing signals modulo the number of harmonic coefficients stored in each one of said harmonic coefficient memory means and for generating a reset signal each time that said first counter means returns to its minimal count state, a plurality of accumulated frequency number generators for generating numbers in response to frequency numbers read out from said plurality of frequency number memory means, a plurality of adder-accumulator means, each one of which is associated with a corresponding one of said plurality of accumulated frequency number generators and each one of which comprises an accumulator, for creating celeste sinusoid argument data values by successively adding a corresponding one of said accumulated frequency numbers to the content of an associated accumulator in response to said reset signal, an accumulated celeste frequency number generator means for generating an accumulated celeste frequency number in response to said first celeste frequency number read out from said first celeste frequency number memory means and in response to said second celeste frequency number read out from said second celeste frequency number memory means, a celeste adder-accumulator means, comprising a celeste accumulator, for creating a celeste sinusoid argument data value by successively adding said accumulated celeste frequency number to the content of said celeste accumulator in response to said reset signal, a second counter means having a plurality of count states for counting each said reset signal modulo a number equal to one integer larger than the number of said plurality of musical tones having an ensemble effect, a first data select means, responsive to count states of said second counter means, for selecting either a sinusoid argument value from one of said plurality of adder-accumulator means or said celeste sinusoid argument value from said adder-accumulator means, a sinusoid table means for storing a plurality of trigonometric sinusoid function values, a sinusoid addressing means for reading out a trigonometric sinusoid function value from said sinusoid table means in response to either said sinusoid argument data value or said celeste sinusoid argument data value selected by said first data select means, a second data select means, responsive to count states of said second counter means, for either selecting harmonic coefficients read out from said plurality of harmonic coefficient memory means or selecting harmonic coefficients read out from said celeste harmonic coefficient memory means, a first multiplying means for generating product data values by mutliplying said harmonic coefficient values selected by said second data select means with said trigonometric sinusoid function value read out from said sinusoid table, a plurality of tone producing means each of which is associated with a corresponding one of said plurality of musical tones having an ensemble effect for generating said plurality of musical tones having an ensemble effect is generated in response to said product data values created by said first multiplying means, a celeste tone producing means for generating a musical tone having a celeste effect in response to said product data values created by said first multiplying means, and a third data select means, responsive to count states of said second counter means for either providing said product data values to one of said plurality of tone producing means or for providing said product data values to said celeste tone producing means.

12. Apparatus according to claim 11 wherein said accumulated celeste frequency number generator means comprises;

a select signal generator means for generating a select signal in response to the count state of said first counter means exceeding a prespecified count state, a first frequency number latch for storing said first celeste frequency number read out from said first celeste frequency number memory means, a second frequency number latch for storing said second celeste frequency number read out from said second celeste frequency number memory means, a first frequency number adder-accumulator means, comprising a first accumulator, for successively adding said first celeste frequency number to said first accumulator to create a first accumulated celeste frequency number, a second frequency number adder-accumulator means, comprising a second accumulator, for successively adding said second celeste frequency number to said second accumulator to create a second accumulated celeste frequency number, and a celeste frequency number select means for creating said accumulated celeste frequency number by either selecting said first accumulated frequency number or said second accumulated frequency number in response to said select signal.

13. In combination with a keyboard operated musical instrument having an array of keyswitches capable of being actuated and having a plurality of tone generators, apparatus for simultaneously producing a plurality of musical tones having an ensemble effect and having all overtone frequencies less than a prespecified maximum frequency comprising;

an assignor means for generating a detect data word in response to each actuated keyswitch in said array of keyswitches, for assigning one of said plurality of tone generators to each said actuated keyswitch, and for providing an associated detect data word to the corresponding said assigned tone generator, a frequency number generating means for providing to each said assigned tone generator a plurality of frequency numbers in response to said associated detect data word provided to said assigned tone generator, a maximum harmonic number generating means for providing a maximum harmonic number to each said assigned tone generator in response to said corresponding detect data word provided to said assigned tone generator, and said plurality of tone generators each of which comprises, a plurality of harmonic coefficient memory means for storing preselected sets of harmonic coefficients wherein each one of said plurality of harmonic coefficient means is associated with a corresponding one of said plurality of musical tones having an ensemble effect, a harmonic memory addressing means for reading out harmonic coefficients from said plurality of harmonic coefficient memory means, a computing means for computing in real time a plurality of sequences of waveshape data words wherein each sequence of waveshape data words is computed in a cyclic order and wherein said computing means is responsive to said harmonic coefficients read out from said plurality of harmonic coefficient memory means, is responsive to said plurality of frequency numbers provided to said assigned tone generator, and is responsive to said maximum harmonic number provided to said assigned tone generator, and a conversion means for combining said plurality of sequences of waveshape data words and for producing said plurality of musical tones having an ensemble effect.

14. Apparatus according to claim 13 wherein said computing means comprises;

a clock means for providing timing signals, a first counter means having a plurality of count states for counting said timing signals modulo the number of harmonic coefficients stored in each one of said harmonic coefficient memory means and for generating a reset signal each time that said first counter means returns to its minimal count state, a plurality of accumulated frequency number generator means for generating accumulated frequency numbers in response to said plurality of frequency numbers provided to said assigned tone generator, a plurality of adder-accumulator means, each one of which comprises an accumulator, for generating sinusoid argument data values by successively adding a corresponding one of said plurality of accumulated frequency numbers to the content of an associated accumulator in response to said reset signal, a second counter means having a plurality of count states for counting each said reset signal modulo the number of said plurality of musical tones, a plurality of scaling means, each one of which is associated with a corresponding one of said plurality of adder-accumulator means, for scaling in magnitude said sinusoid argument data values to produce a plurality of scaled sinusoidal argument values in response to said maximum harmonic number provided to said assigned tone generator, a first data select means for selecting one of said plurality of scaled sinusoid argument data values in response to the count state of said second counter means, a sinusoid table means for storing a plurality of trigonometric sinusoid function values, a sinusoid addressing means for reading out a trigonometric sinusoid function value from said sinusoid table means in response to a scaled sinusoid argument data value selected by said first data select means, a second data select means, responsive to a count state of said second counter means, for selecting harmonic coefficients read out from said plurality of harmonic coefficient memory means, a first multiplying means for generating product data values by multiplying harmonic coefficient values selected by said second data select means with said trigonometric sinusoid function value read out from said sinusoid table means, a plurality of tone producing means, each one of which is associated with a corresponding one of said plurality of musical tones wherein said plurality of musical tones, for generating said plurality of musical tones having an ensemble effect in response to said product data values generated by said first multiplying means, and a third data select means for selectively providing said product data values to one of said plurality of tone producing means in response to a count state of said second counter means.

15. Apparatus according to claim 14 wherein each one of said plurality of accumulated frequency number generators comprises;

a frequency number latch for storing a corresponding one of said frequency numbers provided to said assigned tone generator, and a frequency number adder-accumulator means, comprising a number accumulator, for generating said accumulated frequency number by successively adding the frequency number stored in said frequency number latch to said number accumulator in response to said reset signal.

16. Apparatus according to claim 14 wherein each one of said plurality of scaling means comprises;

a comparator means, responsive to said timing signals, for generating a scale increment signal each time the count state of said first counter means is greater than or equal to said maximum harmonic number, a scaler adder-accumulator means, comprising a scaler accumulator, for generating a scale control signal by successively adding said scale increment signal to the content of said scaler accumulator in response to said reset signal, and scaling circuitry means for scaling in magnitude said sinusoid argument associated with the corresponding scaling means, in response to said scale control signal.

17. Apparatus according to claim 16 wherein said scaling circuitry means comprises;

a binary shift means for right-shifting said sinusoid argument, expressed in binary numeric format, by a number of bits corresponding to the content of said scaler accumulator in said scaler adder-accumulator means.

18. Apparatus according to claim 14 wherein said clock means comprises;

a time signal generating means for providing a sequence of clock signals, a harmonic data latch means for storing said maximum harmonic number provided to said assigned tone generator, and a frequency division means for generating said timing signals at a frequency responsive to said maximum harmonic number stored in said harmonic data latch means.

19. Apparatus according to claim 14 wherein each one of said plurality of scaling means comprises;

a comparator means responsive to said timing signals for generating a scale increment signal each time the count state of said first counter means is greater than or equal to said maximum harmonic number, a scaler adder-accumulator means, comprising a scaler accumulator, for generating a scale control signal by successively adding said scale increment signal to the content of said scaler accumulator and comprising means for initializing the content of said scaler accumulator in response to said reset signal, quadrant reset means for modifying said sinusoid argument by setting the most significant bit of said sinusoid argument, expressed in binary digital format, in response to a nonzero numeric content in said scaler accumulator of said scaler adder-accumulator means, and scaling circuitry means for scaling in magnitude said sinusoid argument in response to said scale control signal.

20. Apparatus according to claim 1 wherein said computing means comprises;

a clock for providing time signals, a first counter means having a plurality of count states for counting said timing signals modulo the number of harmonic coefficients stored in each one of said harmonic memory means and for generating a reset signal each time that the count state of said first counter means returns to its minimal count state, a plurality of accumulated frequency number generator means for generating an accumulated frequency number in response to said plurality of frequency numbers provided to said assigned tone generator, a plurality of adder-accumulator means, each one of which comprises an accumulator, for generating sinusoid argument data values by ssuccessively adding a corresponding one of said plurality of accumulated frequency numbers to the content of an associated accumulator in response to said reset signal, a second counter means having a plurality of count states for counting each said reset signal modulo the number of said plurality of musical tones, a first data select means for selecting in response to count states of said second counter means a sinusoid argument data value from said plurality of adder-accumulator means, a second data select means for selecting, in response to count states of said second counter means, harmonic coefficients read out from said plurality of harmonic coefficient memory means, a data generation means for generating product data values in response to said harmonic coefficient values selected by said second data select means and in response to said sinusoid argument data values selected by said first data select means, a plurality of tone producing means, each one of which is associated with a corresponding one of said plurality of musical tones for generating said plurality of musical tones in response to said product data values generated by said data generation means, and a third data select means for selectively providing said product data values to one of said plurality of tone producing means in response to count states of said second counter means.

21. Apparatus according to claim 20 wherein said data generation means comprises;

a product data memory means for storing a set of said product data values, and a product memory reading means for reading out a product data value from said product data memory means in response to said sinusoid argument data values selected by said first data select means and in response to a harmonic coefficient value selected by said second data select means.

22. In combination with a keyboard operated musical instrument having an array of keyswitches capable of being actuated and having a plurality of tone generators, apparatus for simultaneously producing a plurality of musical tones having an ensemble effect in response to each actuated keyswitch comprising;

an assignor means for generating a detect data word in response to each actuated keyswitch in said array of keyswitches and for assigning one of said plurality of tone generators to each said actuated keyswitch and for providing an associated detect data word to a corresponding assigned tone generator in said plurality of tone generators, a frequency number generating means for providing to each said assigned tone generator a plurality of frequency numbers in response to said associated detect data word provided to each said assigned tone generator wherein each one of said plurality of frequency numbers has an individual prespecified offset numerical value; and said plurality of tone generators each of which comprises;

a plurality of harmonic coefficient memory means for storing a plurality of sets of harmonic coefficients wherein each one of said harmonic coefficient memory means is associated with a corresponding one of said plurality of musical tones and stores one set of harmonic coefficients of said plurality of sets of harmonic coefficients, a harmonic memory addressing means for reading out said harmonic coefficients from said plurality of harmonic coefficient memory means, a computing means for continuously computing in real time a plurality of sequences of waveshape data words wherein each sequence of waveshape data words in said plurality of sequences of waveshape data words is computed in cyclic order and wherein said computing is in response to said harmonic coefficients read out from said plurality of harmonic coefficient memory means and in response to said plurality of frequency numbers provided to said assigned tone generator, an ADSR envelope function generator for providing a plurality of envelope function values in said cyclic order, an ADSR scaling means for scaling in magnitude said plurality of sequences of waveshape data words computed by said computing means in response to said plurality of envelope function values provided by said ADSR envelope function generator to produce a plurality of ADSR scaled sequences of data words, and a conversion means for combining said plurality of sequences of data words and for producing said plurality of musical tones having an ensemble effect.

* * * * *